US005193044A

United States Patent [19]

Czerwiec

[11] Patent Number: 5,193,044

[45] Date of Patent: Mar. 9, 1993

[54] APPARATUS FOR LINE CARD POWER CROSS PROTECTION

[75] Inventor: Richard M. Czerwiec, Raleigh, N.C.

[73] Assignee: Alcatel Network Systems, Inc., Richardson, Tex.

[21] Appl. No.: 576,201

[22] Filed: Aug. 29, 1990

[51] Int. Cl.[5] ..... H01H 37/00

[52] U.S. Cl. ..... 361/104; 361/119; 361/124; 337/183

[58] Field of Search ..... 361/103, 104; 337/177, 337/178, 190, 219, 184

[56] References Cited

U.S. PATENT DOCUMENTS

| | | | |
|---|---|---|---|
| 2,276,184 | 3/1942 | Garrison, Jr. | 337/184 |
| 2,548,491 | 4/1951 | Peek, Jr. | 361/104 |
| 4,652,848 | 3/1987 | Hundrieser | 337/297 |

FOREIGN PATENT DOCUMENTS

| | | | |
|---|---|---|---|
| 0230109 | 11/1985 | Fed. Rep. of Germany | 337/184 |

*Primary Examiner*—A. D. Pellinen
*Assistant Examiner*—S. Jackson
*Attorney, Agent, or Firm*—Ware, Fressola, Van Der Sluys & Adolphson

[57] ABSTRACT

A heat generating means, such a resistive element, is serially connected in a current-carrying conductive line, and a fusible link carrying current from said line is serially mounted between the line and said resistive element and is positioned in proximity to the heat generating means, to be heated by the heat from the generating means and to melt in response thereto, thereby breaking the serial connection in the current-carrying line. A spring means may be provided to urge disconnection of the serial circuit when the fusible link melts.

15 Claims, 1 Drawing Sheet

APPARATUS FOR LINE CARD POWER CROSS PROTECTION

BACKGROUND OF THE INVENTION

1. Field of the Invention

The present relates to line card protection and, more particularly, to an apparatus for protecting a line card during power cross situations.

2. Description of the Prior Art

Telephone line cards are connected to subscriber equipment by a pair of metallic wires called tip and ring lines. A series resistor of approximately 100 ohms is usually inserted in each of the lines to limit and adjust line current. During normal operation the lines are subjected to approximately 40–50 volts DC, which results, in conjunction with the series resistors and the normal loop resistance, in a current of 20–40 ma.

In many situations, the metallic telephone lines are strung on utility poles below power distribution lines and, on occasion, a live power line can accidentally fall across the metallic telephone lines, causing the line card to be subjected to high voltage levels which may range between 220 to over 1000 volts. This situation is known in the art as power cross, and it is essential that the line card be protected in such situations. The line card should preferably be protected from failure, and it is extremely important that the card not overheat to a level that could cause a fire.

Using a fuse in such a situation would appear to be the normal solution; however, it has been found that the resistance in the line limits the current to an extent that it is not high enough to cause a fuse to melt. Thus, in many instances, high current levels are provided to the line card circuit for an extended period of time, causing card failure and possible heat buildup and the risk of fire.

Heretofore, an effective, inexpensive solution to this potentially disastrous problem has not been provided.

SUMMARY OF THE INVENTION

The present invention contemplates a simple, yet effective, solution to the problem of line card protection from disastrous power cross situations. The invention uniquely uses the concept of placing a fuse, or fusible link, in proximity to a heat generator which will provide sufficient heat to cause the fuse to melt when excessively high currents are experienced. The invention uses the standard series resistors provided in the tip and ring lines as the heat source and the solder holding the resistor in place on line card posts as the fuse.

Preferably the resistor will be pivotably mounted to a first post and oriented such that when the solder melts the resistor may swing out of contact with a second post. The line card and resistor should be oriented so that gravity pulls the resistor away from the second post. When small resistors, which do not have sufficient weight to assure that the effects of gravity will move them out of contact, are used, a simple spring mechanism may be used to provide torque to break the contact. The use of a spring could also eliminate the need for a particular orientation of the resistor, since the effects of gravity would not be needed.

It is contemplated that the resistor or resistor spring combination may be mounted directly on a printed circuit board for the line card, or could be implemented as a discrete device to be installed as a separate component on the line card.

A primary objective of the present invention is to provide a means of protecting a line card from destructive power cross situations, such as to prevent overheating the line card.

Another objective of the present invention is to provide a device that is simple, inexpensive and yet effective in providing this protection.

Another objective of the present invention is to provide a line card power cross protection device that may be implemented using standard components and mounted on a printed circuit board.

Another objective of the present invention is to provide a power cross protection device for a line card that is constructed as a separate, discrete power cross protection component.

Another objective is to make failure on the card due to power cross obvious in nature, and easily field repairable.

DETAILED DESCRIPTION OF THE PREFERRED EMBODIMENT

Figure 1:
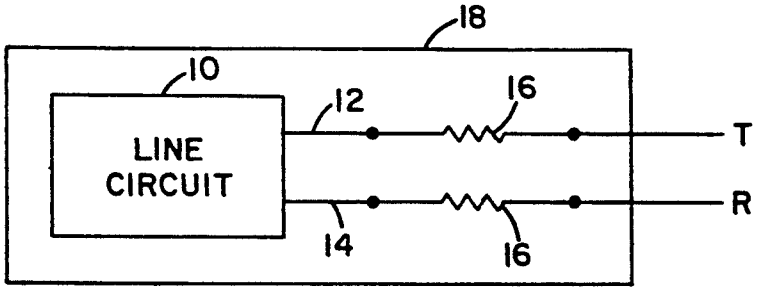
FIG. 1 (PRIOR ART)
FIG. 1 is a schematic diagram illustrating the standard arrangement of a line card connected to tip and ring lines, with series resistors disposed within the tip and ring lines.

Referring to FIG. 1, there is shown a schematic diagram of the standard environment in which the present invention may be utilized. A line circuit 10 has connected thereto metallic tip and ring lines 12 and 14, respectively. A resistor 16 is disposed serially in each of the tip and ring lines.

The resistors vary in value, depending upon the line circuit, the particular application to which it is used, and also the length of the tip and ring lines. Nominally, the resistors 16 are 100 ohms each and are standard 2-watt metal film resistors. The resistors are typically mounted to posts on a printed circuit board 18 which forms the line card.

Figure 2:
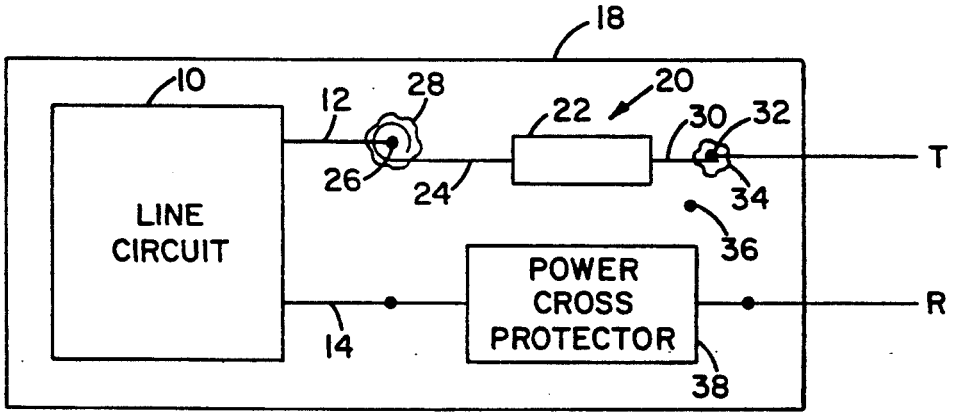
FIG. 2 schematically illustrates the use of the present invention in conjunction with a line card.

Referring to FIG. 2, there is shown the printed circuit board 18 having mounted thereto a line circuit 10, with tip and ring lines 12 and 14 extending therefrom. The power cross protection device 20 of the present invention is shown inserted into the tip line 12. The power cross protection device 20 comprises a standard 2-watt metal film resistor 22, having a first lead 24 loosely wrapped around a post 26 mounted in the printed circuit board 18. The lead 24 is electrically and physically connected to the post through the use of solder 28. The resistor 22 has a second lead 30 connected to a second post 32 solely through the use of solder 34. A third post 36 is positioned a predetermined distance from post 34.

The solder is selected to be a low melting point solder so that the solder melts with a relatively low heat buildup. A standard general-purpose rosin core electronics solder having 60 percent tin and 40 percent lead melts at a temperature between 361° to 374° F. and is well suited for the invention.

In the event of a power cross situation, abnormally high current will flow through resistor 22, causing the resistor to heat up to a temperature higher than normal, and the resistor effectively functions as a heat source. The leads 24 and 30 are maintained as short as possible; therefore the posts 26 and 32 are in close proximity to the body of the resistor 22, so that the solder 28 and 34 is influenced by the heat generated by the resistor 22, said heat being conveyed through the leads 24 and 30.

As the temperature of the resistor builds up, the solder will be heated and will begin to melt. When the solder melts, the force of gravity pulls the resistor downwardly away from post 32, while lead 24 loosely wrapped around post 26 functions as a hinge. When the resistor falls away from post 32, the power cross is effectively disconnected from the line card. Preferably, post 36 is provided as a stop to limit the angular motion of resistor 22, so that it does not contact other components on the printed circuit board 18.

As mentioned above, the leads 24 and 30 of the resistor must be kept as short as possible to allow the most effective transfer of heat from the resistor to the solder. The posts 26 and 30 should be short and have a small diameter, so that they do not function as a heat sink. It has been determined that a spacing of one-quarter inch between the resistor and the post provides a satisfactory lead length. The post diameter should be approximately the diameter of the leads 24 and 30 to minimize the heat sink effect.

The power cross protection device 20 of the present invention can be made of discrete components, as shown in FIG. 2, or the components can be mounted in a separate housing to provide a separate power cross protector 38, as is shown connected in the ring line 14.

Figure 3:
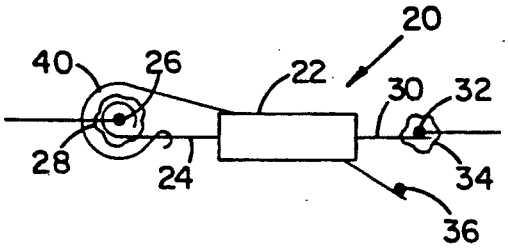
FIG. 3 illustrates a second embodiment of the present invention.

If the resistors are exceptionally small and lightweight, or the orientation of the power cross protection device 20 does not facilitate the use of gravity for releasing the resistor from the post 32, it is contemplated that an additional spring mechanism 40 may be used, as shown in FIG. 3. The spring may be a simple spring wire having a looped end mounted around the lead 24, with the wire being wrapped around post 26 and extending to engage post 36 so that the spring is fully tensioned and applies a torque to the resistor 22. Preferably the spring is mounted after the resistor is soldered in place. This makes the soldering step easier and assures that the spring is not soldered in place and is free to exert a torque even before the solder is fully melted.

The power cross protection device shown in FIG. 3 could be mounted as a separate component 38, or could also be mounted as discrete components on a printed circuit board.

Thus, it can be seen that the present invention provides a unique device for power cross protection for line cards. The power cross protection device of the present invention is extremely simple and can be manufactured from standard off-the-shelf components, or could be embodied as a separate component within its own housing, with the components each being rated as to resistance and a selected current rating at which the fusible link will melt. The present invention comprises a simple, inexpensive, yet effective, solution to the power cross problem.

What is claimed is:

1. An apparatus for protecting a circuit from excessive current provided by a current-carrying metallic line connected to said circuit, said apparatus comprising:

resistive means, having first and second leads serially connected in said line, for generating heat in response to current carried in said line; and fusible material means disposed in proximity to said resistive means and being responsive to said heat for breaking the serial connection of the resistive means in said current-carrying line; and said first lead being hingedly connected and joined by said fusible material means to a first terminal post in said circuit, and the second lead being detachably mounted by said fusible material means to a second terminal post in said circuit.

2. An apparatus as described in claim 1, wherein the fusible material means comprises solder.

3. An apparatus as described in claim 1, wherein the resistive element means comprises an electrical resistor.

4. An apparatus as described in claim 1, additionally comprising means for urging the resistor away from the second post.

5. An apparatus as described in claim 4, wherein said means for urging comprises a spring means.

6. An apparatus as described in claim 5, wherein the circuit is mounted on a printed circuit board and the posts are also mounted to the printed circuit board.

7. An apparatus as described in claim 1, wherein the resistor leads are approximately one-quarter inch long so that the solder is in close proximity to the heat producing resistor.

8. An apparatus as described in claim 7, wherein the posts are of a minimal size, so that they do not function as a heat sink to draw heat away from the solder.

9. An apparatus as described in claim 8, wherein the posts and leads have similar diameters.

10. An apparatus as described in claim 4, wherein said means for urging includes orienting the resistive means so that when the fusible material means melts the resistor can swing out of contact with the second terminal post.

11. An apparatus for protecting a circuit from excessive current provided by a current-carrying metallic line connected to the circuit, the apparatus comprising:

a resistor having first and second leads serially connected in the line, for generating heat in response to current carried in the line; and solder disposed in proximity to the resistor and being responsive to the heat for breaking the serial connection of the resistor in the current-carrying line, the first lead of the resistor being hingedly connected and electrically joined by the solder to a first terminal post in the circuit, and the second lead being detachably mounted by the solder to a second terminal post in the circuit; and a spring for applying a torque upon the resistor so that when the solder substantially melts the resistor breaks away from the second terminal post and pivotally swings about the first terminal post.

12. An apparatus as described in claim 11, wherein the cicuit is mounted on a printed circuit board and the first and second terminal posts are also mounted to the printed circuit board.

13. An apparatus as described in claim 11, wherein the resistor leads are approximately one-quarter inch long so that the solder is in close proximity to the heat producing resistor.

14. An apparatus as described in claim 11, wherein the first and second terminal posts are of a minimal size, so that they do not function as a heat sink to draw heat away from the solder.

15. An apparatus as described in claim 11, wherein the first and second terminal posts and leads have similar diameters.

* * * * *